US005828286A

United States Patent [19]

Hofsäss

[11] Patent Number: 5,828,286

[45] Date of Patent: Oct. 27, 1998

[54] TEMPERATURE-DEPENDENT SWITCH

[76] Inventor: Marcel Hofsäss, Bodelschwinghstr. 36, D-75179 Pforzheim, Germany

[21] Appl. No.: 760,860

[22] Filed: Dec. 5, 1996

[30] Foreign Application Priority Data

Dec. 9, 1995 [DE] Germany ..... 195 45 997.0

[51] Int. Cl.[6] ..... H01H 37/00; H01H 37/74; H01H 37/52; H01H 37/54

[52] U.S. Cl. ..... 337/343; 337/298; 337/362; 337/365; 337/380

[58] Field of Search ..... 337/343, 298, 337/333, 342, 347, 348, 349, 354, 362, 365, 368, 380, 334, 335, 336, 367, 370, 372, 381, 53; 361/163, 124; 335/141, 145; 200/3; 340/594; 219/265; 62/132, 133

[56] References Cited

U.S. PATENT DOCUMENTS

| | | | |
|---|---|---|---|
| 2,707,738 | 5/1955 | Weissheimer et al. | 337/372 |
| 2,785,252 | 3/1957 | Parr | 337/372 |
| 2,811,611 | 10/1957 | Odenwald | 337/372 |
| 3,213,250 | 10/1965 | Marcoux | 337/373 |
| 3,248,503 | 4/1966 | Huber | 337/373 |
| 4,306,211 | 12/1981 | Hofsass | 337/89 |
| 4,470,033 | 9/1984 | Hofsass | 337/343 |

*Primary Examiner*—Leo P. Picard
*Assistant Examiner*—Anatoly Vortman
*Attorney, Agent, or Firm*—Harness, Dickey & Pierce, P.L.C.

[57] ABSTRACT

A temperature-dependent switch comprises a housing having a lower housing part and a cover part capping said lower housing part. A first countercontact is provided at an inner surface of said cover part, said first countercontact having a projection pointing into said housing. A second countercontact is provided at an inner surface of said lower housing part. Inside of said housing a temperature-dependent switching mechanism is arranged, said mechanism including an electrically conductive spring element having an opening. Dependent on the temperature said spring element assumes at least two distinct switching positions, whereby in its first switching position the spring element is in contact with both said first and second countercontacts, thereby electrically interconnecting said first and second countercontacts. At least when said spring element is in its first switching position, said projection at said first countercontact protrudes into said opening in said spring element, thereby centering the latter in the housing.

14 Claims, 4 Drawing Sheets

TEMPERATURE-DEPENDENT SWITCH

BACKGROUND OF THE INVENTION

1. Field of the Invention

The present invention relates to a switch with a temperature-dependent switching mechanism, a housing, receiving the switching mechanism, that has a lower part and a cover part capping the latter, and a first countercontact provided internally on the cover part as well as a second countercontact provided internally on the lower part, the switching mechanism comprising an electrically conductive spring element that, in one of its switch positions, is in contact with both the first and the second countercontacts.

2. Description of Related Prior Art

A temperature-dependent switch of this kind is known from DE 29 17 482 C2.

The known switch serves to monitor the temperature of a device. To this end, it is connected via its external terminals in series with the device being monitored, and is arranged so that the temperature of the device being monitored influences the temperature of a bimetallic element. If the switching temperature is exceeded, the switching mechanism opens the connection between the two external terminals, and the electric circuit passing through it is interrupted. When the temperature drops, the electric circuit is closed again, although this need not absolutely be the case; bistable temperature-dependent switches are also known.

The known switch has a housing consisting of an electrically conductive lower housing part and an electrically conductive cover part which caps the latter, an insulating film being provided for insulation between the lower housing part and cover part. An inwardly projecting region on the cover part is configured as the first countercontact. The switching mechanism has as the spring element a spring disk on which a movable contact, which comes into contact with the first countercontact, is mounted by means of a crimped rim. A bimetallic snap disk, which below the switching temperature is received unrestrainedly in the housing, is slipped over the spring disk. Current flow occurs via the conductive cover part, the first countercontact, the movable contact, the spring disk, and the conductive lower housing part, on which the spring disk is supported, so that the inner bottom constitutes the second countercontact. External contact is accomplished directly by contact between the lower housing part and cover part.

When the switching temperature is exceeded, the bimetallic snap disk snaps over and pushes the spring disk, with its movable contact, away from the first countercontact.

Mechanical assembly of the known switch is laborious in particular because the contact must be mounted by means of the crimped rim on the spring disk.

A comparable switch is known from DE 37 10 672 A1. This so-called temperature controller is configured to be self-holding, i.e. it comprises a heating resistor, connected in parallel with a bimetallic switching mechanism, which when the switching mechanism is open is connected in series between the external terminals, and heats up as a result of the current flowing through to the point that it keeps the bimetallic switching mechanism above its switching temperature, so that it does not return back to the original state. The high-ohmic resistor is integrated into the cover part, which consists of either insulating material or an electrically conductive resistor material.

In the case of this switch the movable contact is placed loose into the spring disk, and clamped between the spring disk and the bimetallic snap disk by means of a projecting annular shoulder.

The disadvantage here is that during final assembly, which is generally performed manually by semi-skilled personnel, first the spring disk must be placed into the lower housing part, then the contact part into the spring disk, and lastly the bimetallic snap disk must be placed over the contact part. This procedure is very time-consuming, and admits of only limited automation. Moreover it can cause the contact part to slide during assembly, thus increasing rejects.

In order to eliminate these disadvantages, it has already been proposed, in DE 43 37 141 A1, to weld the contact onto the spring disk.

Although this eliminates the aforementioned disadvantages in terms of final assembly of the switch, it is still necessary, as in the case of the switch from DE 29 17 482 C2 mentioned earlier, to mount the contact onto the spring disk by means of additional actions.

In all the known switches discussed so far, the movable contact is a part to be turned that can be manufactured only with corresponding material and production outlay, so that it contributes significantly to the total cost of the known switch.

SUMMARY OF THE INVENTION

Proceeding from this, the object of the present invention is to improve the switch mentioned at the outset in such a way that it has a simple and economical construction and can be easily assembled.

According to the invention, this object is achieved, in the case of the switch mentioned at the outset, by the fact that a projection, which points into the housing and in at least the one switch position protrudes into an opening provided in the spring element, is provided on the first countercontact.

The object underlying the invention is completely achieved in this manner.

Specifically, the inventor of the present application has recognized that, surprisingly, the movable contact element on the spring element can be dispensed with, and that the necessary electrical contact between the spring element and the countercontact can be effected and/or promoted by the fact that a projection, on which the spring disk sits, so to speak, with its opening, is provided on the countercontact. The spring disk is centered in the housing of the new switch by means of this projection, so that rejects during final assembly due to incorrectly placed spring disks are avoided. In addition the projection ensures good, electrically conductive contact between the spring element and the first countercontact in the correctly positioned orientation.

The new switch thus has a whole series of advantages. Firstly, production costs are reduced due to the lower number of components that are in the new switch, since the new countercontact replaces, so to speak, the previous contact element and the previous countercontact. In addition, it is no longer necessary to mount the contact element onto the spring disk before or during final assembly of the switch, so that this production step is superfluous. All in all, therefore, not only are component costs, costs for inventory, and the number of components reduced, but also the time required for final assembly, which now can also be accomplished automatically, thus avoiding further rejects. A further advantage lies in the fact that the number of contact resistance points, i.e. the number of required contact regions, is reduced to the absolute minimum, since the contact resistance between the contact element used in the prior art and the spring disk is omitted. The quality of the overall contact resistance of the switch is thus improved, and problems of material selection with regard to aging are also solved.

It is preferred in this context if the projection is made of electrically conductive material or of electrically insulating material.

The advantage here is that on the one hand the projection can be configured integrally with the countercontact if it also is made of electrically conductive material. If the projection is, however, made of insulating material, it then serves merely to guide the spring element relative to the countercontact, such that it can preferably extend, as a guide pin, to the bottom of the lower housing part.

While in the case of the projection produced from electrically conductive material, even greater contact reliability is provided between the spring element and the first countercontact, in the case of the projection produced from electrically insulating material, better guidance and centering of the spring part in the housing is made possible by the fact that the projection extends, as a guide pin, to the bottom of the lower housing part, although because of its insulating capability it does not lead to a short circuit.

In a development, it is preferred if the spring element is retained in lossproof fashion on the projection.

The advantage here is that the spring element can be placed on the projection, which is mounted on the cover part, before final assembly of the switch, and can then be joined in lossproof fashion to the projection, for example by crimping or welding. This also greatly simplifies assembly of the new switch, since placement of a spring disk onto a projection is easier to automate than insertion of a spring disk into a usually cup-shaped housing.

It is further preferred if the projection has a thickened head over which the spring element is slid in snap-lock fashion.

The advantage here is that it not absolutely necessary, after the spring element has been placed onto the projection, to ensure lossproof retention by means of additional actions such as crimping or welding. Instead the spring disk is slid over the thickened head while overcoming a mechanical resistance, so that it snap-locks onto the projection. This feature also provides for much simpler final assembly of the new switch, since further production steps can be eliminated.

In one embodiment, it is preferred if the spring element is a pretensioned bimetallic snap disk; it is also preferred if a bimetallic snap disk that is arranged with its opening on the projection is associated with the spring element.

If the spring element itself is a pretensioned bimetallic snap disk, the result is a very simple switching mechanism, since the additional spring disk used in the prior art can be omitted. The bimetallic snap disk then ensures both electrical contact between the two countercontacts, and temperature-dependent switching of the switching mechanism.

If, however, a separate bimetallic snap disk is provided, against which the spring element operates, the result is the advantage, known per se, that any shift in switching temperature is prevented, in particular with a large number of switching cycles. Specifically, the spring element presses the bimetallic snap disk into the switch position in which, for example, the two countercontacts are interconnected in electrically conductive fashion. When the bimetallic snap disk then heats up, a gradual deformation of this bimetallic snap disk then occurs at its rim, which lifts away from the bottom. During this so-called crawling phase, however, the spring element ensures that the electrically conductive connection between the two countercontacts is maintained. Only when the bimetallic snap disk abruptly snaps over, i.e. jumps from its convex shape into a concave shape, is the spring element lifted away from the countercontact by the action of the bimetallic snap disk.

It is further preferred if the cover part is made of electrically conductive material, and if the countercontact is deep-drawn out of the material, the projection also preferably being deep-drawn out of the material.

This feature is advantageous in terms of design, since by suitable profiling of the inside of the cover part, both the countercontact and the projection provided on it can be configured in a single operation. As a result, not only is the number of individual parts required for the new switch further reduced, but the number of assembly steps required for final assembly of the new switch is also further decreased.

Lastly, it should be mentioned that both a spring disk and a cup spring or spiral spring can be used as the spring element.

Further advantages are evident from the description and the attached drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

The invention is depicted in the drawings and will be explained further in the description below, in which.

DESCRIPTION OF THE PREFERRED EMBODIMENTS

Figure 1:
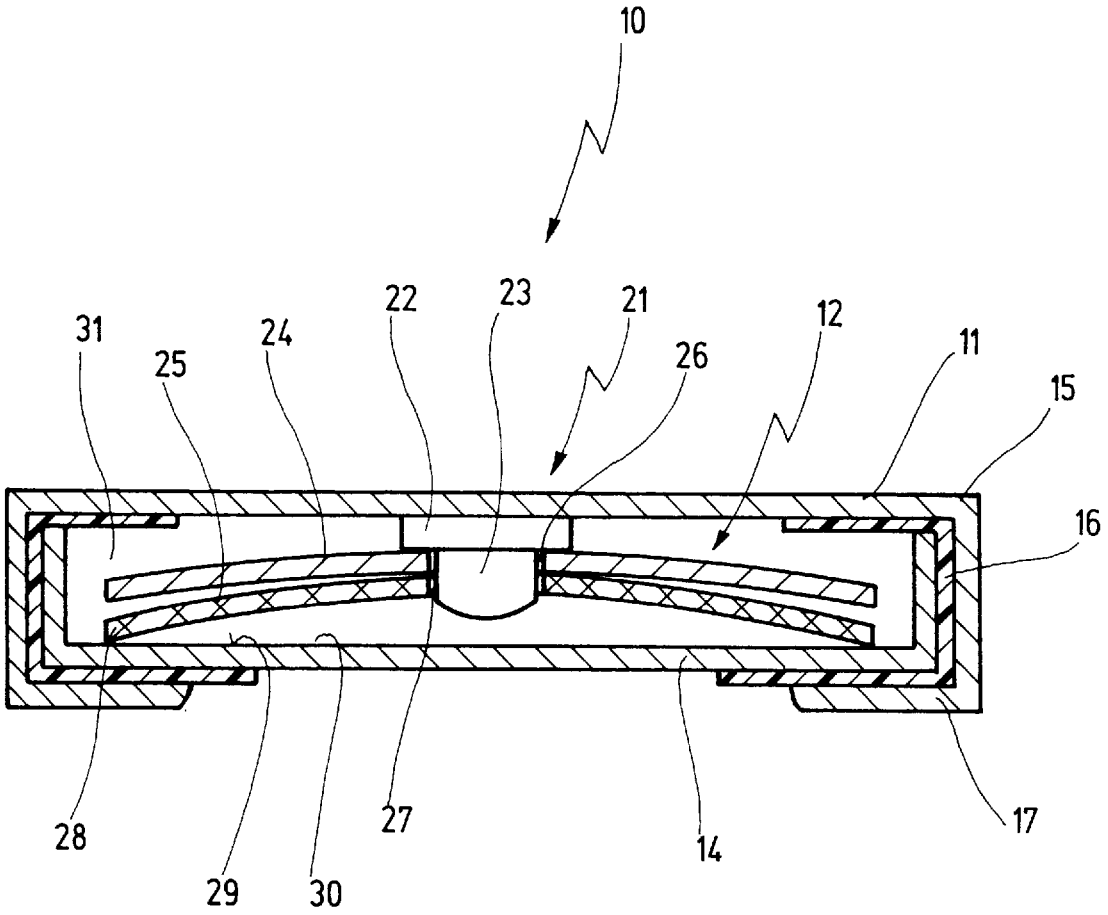
FIG. 1 shows a first embodiment of the new switch in a schematic longitudinal section.

In FIG. 1, 10 indicates, schematically in longitudinal section, a switch which comprises a housing 11 in which a temperature-dependent switching mechanism 12 is arranged.

Housing 11 comprises a lower housing part 14 and a cover part 15 which caps the latter. Since both lower housing part 14 and cover part 15 are made of electrically conductive material, an insulating film 16 is arranged between them. In the assembled state shown in FIG. 1, the cover part is mounted on lower housing part 14 by means of a crimped rim 17, with insulating film 16 interposed.

Switch 10 is connected electrically by the fact that, for example, conductors or crimp terminals are soldered onto both lower housing part 14 and cover part 15. For reasons of clarity, these terminals are not depicted in the drawings.

A first countercontact 21 is soldered or welded at its bottom 22 onto the inside of cover part 15, so that an electrically conductive connection exists between first countercontact 21 and cover part 15.

First countercontact 21 moreover has a projection 23, pointing into housing 11, which in the embodiment shown in FIG. 1 is configured integrally with bottom 22, i.e. is also made of electrically conductive material. Of course it is also possible to produce projection 23 from an electrically insulating material and adhesively bond it onto, for example bottom 22.

Switching mechanism 12 arranged in housing 11 comprises a bimetallic snap disk 24 as well as a spring disk 25 arranged beneath the latter. Bimetallic snap disk 24 and spring disk 25 are arranged with their openings 26 and 27 on projection 23 which is provided centeredly on cover part 15, so that bimetallic snap disk 24 and spring disk 25 are centered in housing 11 by means of the arrangement selected.

Spring disk 25 is supported at its rim 28 on the inner bottom 29 of lower housing part 14, which acts as second countercontact 30. In the switch position shown in FIG. 1, an electrically conductive connection thus exists from cover part 15 via first countercontact 21 and spring disk 25 to lower housing part 14, projection 23 ensuring, by way of a centering effect, that spring disk 25 and bimetallic snap disk 24 do not slide with respect to first countercontact 21; this therefore improves contact reliability.

When the temperature of switching mechanism is then raised due to heating of a load being monitored, bimetallic snap disk 24 thus bends, upward in FIG. 1, at its rim 31, while spring disk 25 continues to provide the electrical connection between lower housing part 14 and cover part 15. When the switching temperature of switching mechanism 12 is then exceeded, bimetallic snap disk 24 suddenly snaps over from its concave shape (as shown) to a convex shape. It then rests with its rim 31 against insulating film 16 at the top, and pushes spring disk 25 downward onto bottom 29 of lower housing part. Electrical contact with first countercontact 21 is thus broken, so that switch 10 is, so to speak, open.

Because of the centering effect achieved by means of openings 26 and 27 as well as projection 23, after the temperature drops bimetallic snap disk 24 and spring disk 25 again orient themselves in housing 11 in the manner shown in FIG. 1. The operating reliability of this switch 10 is thus, however, very high, since "mispositioning" of elements of switching mechanism 12 cannot occur.

This centering is also advantageous during final assembly of the new switch 10, since when cover part 15 is slid onto lower housing part 14, bimetallic snap disk 24, previously introduced into lower housing part 24, and spring disk 15 are automatically centered over projection 23.

Figure 2:
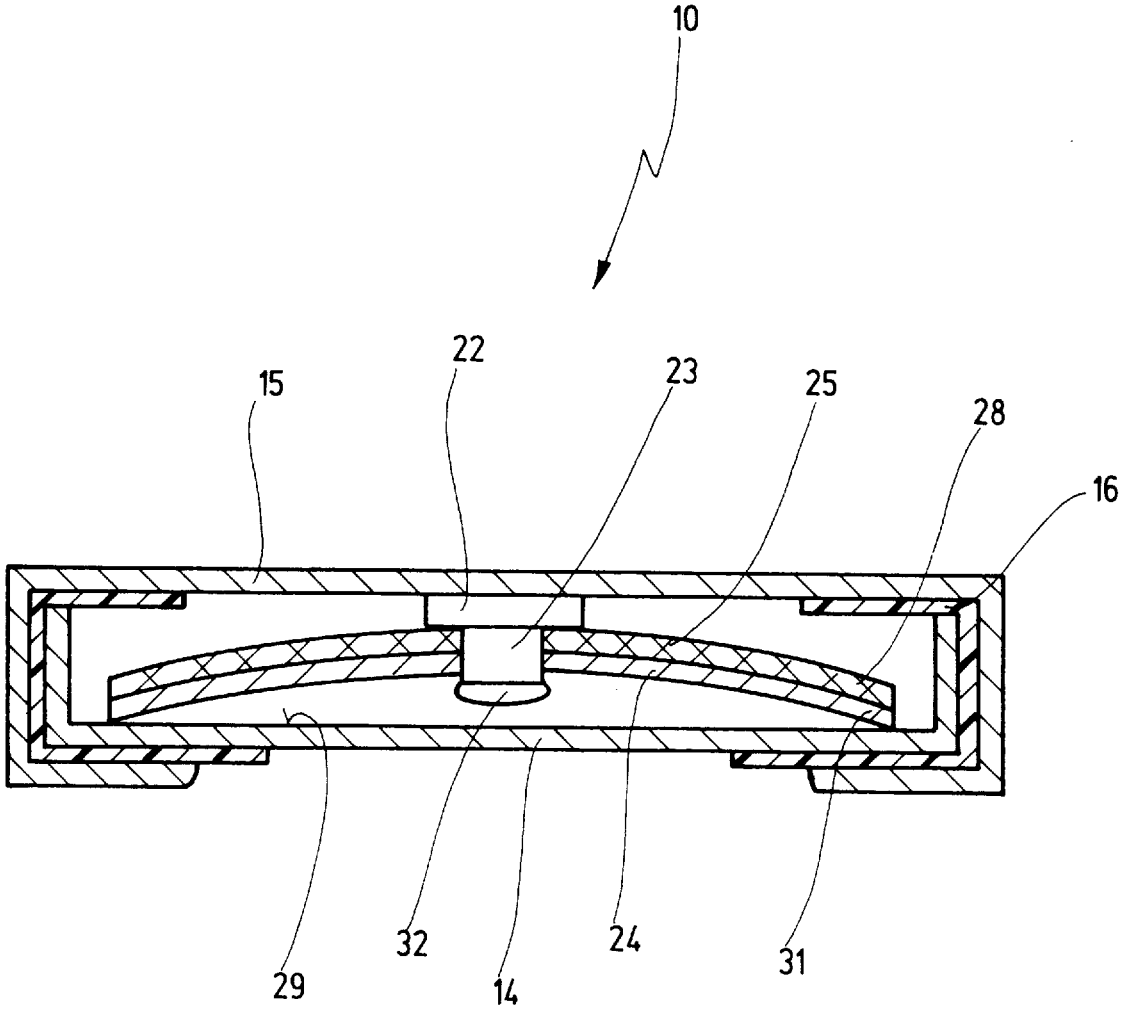
FIG. 2 shows a second embodiment of the new switch in a schematic longitudinal section.

In the second embodiment shown in FIG. 2, there is arranged on projection 23 a thickened head 32 by means of which bimetallic snap disk 24 and spring disk 25 are held in lossproof fashion on first countercontact 21 and thus on cover part 15. This head can on the one hand be produced, by expansion or crimping, after bimetallic snap disk 24 and spring disk 25 have been slid onto projection 23; but it can also be provided earlier during the production of first countercontact 21. In the latter case, head 32 is then dimensioned so that openings 26 and 27 can be pushed over it under pressure, so that bimetallic snap disk 24 and snap disk 25 are, so to speak, snap-locked onto projection 23.

During the final assembly of switch 10 shown in FIG. 2, the individual parts of switching mechanism 12 can therefore first be installed on cover part 15 before cover part 15 is slid onto lower housing part 14.

It is also evident from FIG. 2 that here the sequence of bimetallic snap disk 24 and spring disk 25 is reversed as compared with the embodiment of FIG. 1: spring disk 25 is located above bimetallic snap disk 24. When the temperature in housing 11 then increases, bimetallic snap disk 24 thus lifts away from bottom 29 at its rim 31, and presses its rim 31 upward, against the force of spring disk 25, against insulating film 16.

In this specific embodiment it is not absolutely necessary to provide, in addition to bimetallic snap disk 24, a spring disk 25. Specifically, the latter can be omitted if bimetallic snap disk 24 itself is configured as a pretensioned spring element, so that below its switching temperature it assumes the position shown in FIG. 2. Since bimetallic snap disk 24 is generally also made of electrically conductive material, it can thus itself provide an electrical connection between cover part 15 and lower housing part 14.

Figure 3:
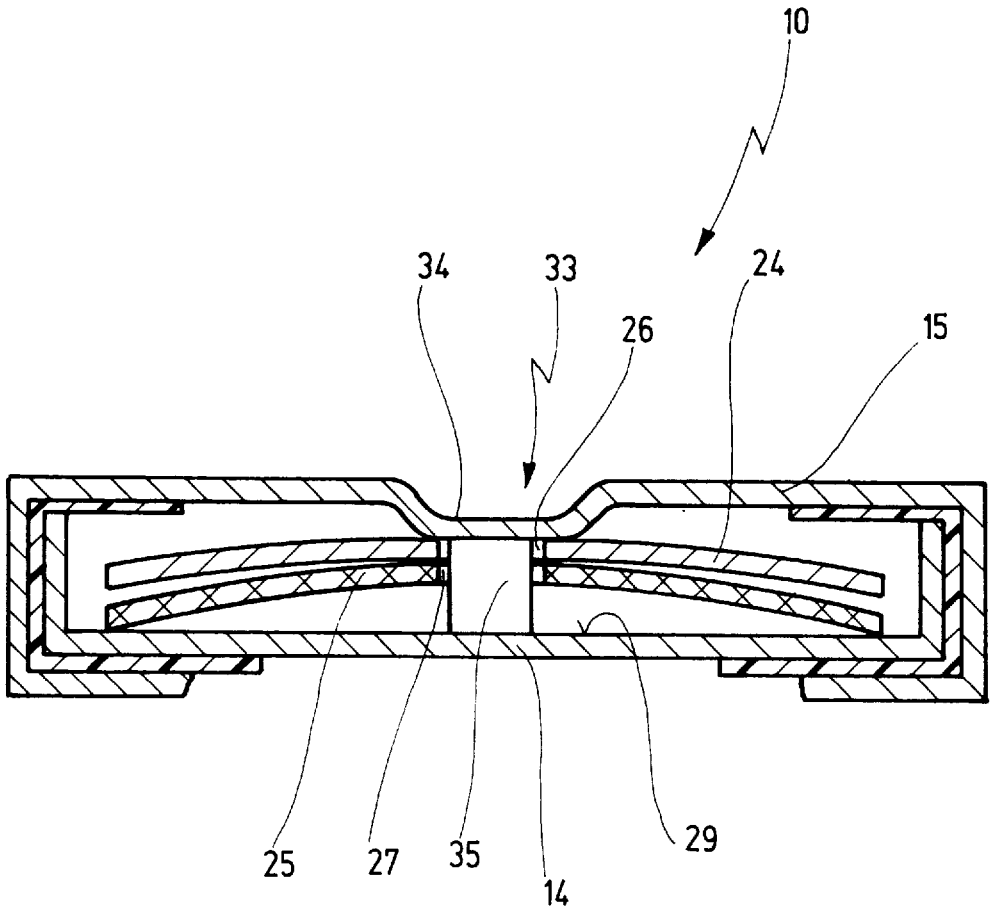
FIG. 3 shows a third embodiment of the new switch in a schematic longitudinal section.

In the case of the embodiment shown in FIG. 3, the arrangement of bimetallic snap disk 24 and spring disk 25 once again corresponds to the design shown in FIG. 1. A deep-drawn lug 34 is now provided on cover part 15 as first countercontact 33, so that first countercontact 33 is configured, so to speak, integrally with cover part 15. Adjoining lug 34 as the projection is a guide pin 35, which extends to bottom 29 of lower housing part 14.

Bimetallic snap disk 24 and spring disk 25 then sit with their openings 26 and 27 on this guide pin 35.

The operation of switch 10 shown in FIG. 3 corresponds exactly to that of switch 10 shown in FIG. 1, although cover part 15 is manufactured more simply. Guide pin 35 is made of insulating material and, for example, adhesively bonded onto lug 34. It is also possible, however, to bond guide pin 35 onto bottom 29, so that it can already be exerting its centering effect during final assembly of switch 10 when bimetallic snap disk 24 and spring disk 25 are introduced. If guide pin 35 is, on the other hand, adhesively bonded onto lug 34, then during final assembly of switch 10 first bimetallic snap disk 24 and spring disk 25 are slid onto guide pin 35, before lower housing part 14 is then slid into cover part 15 and crimped to it.

Figure 4:
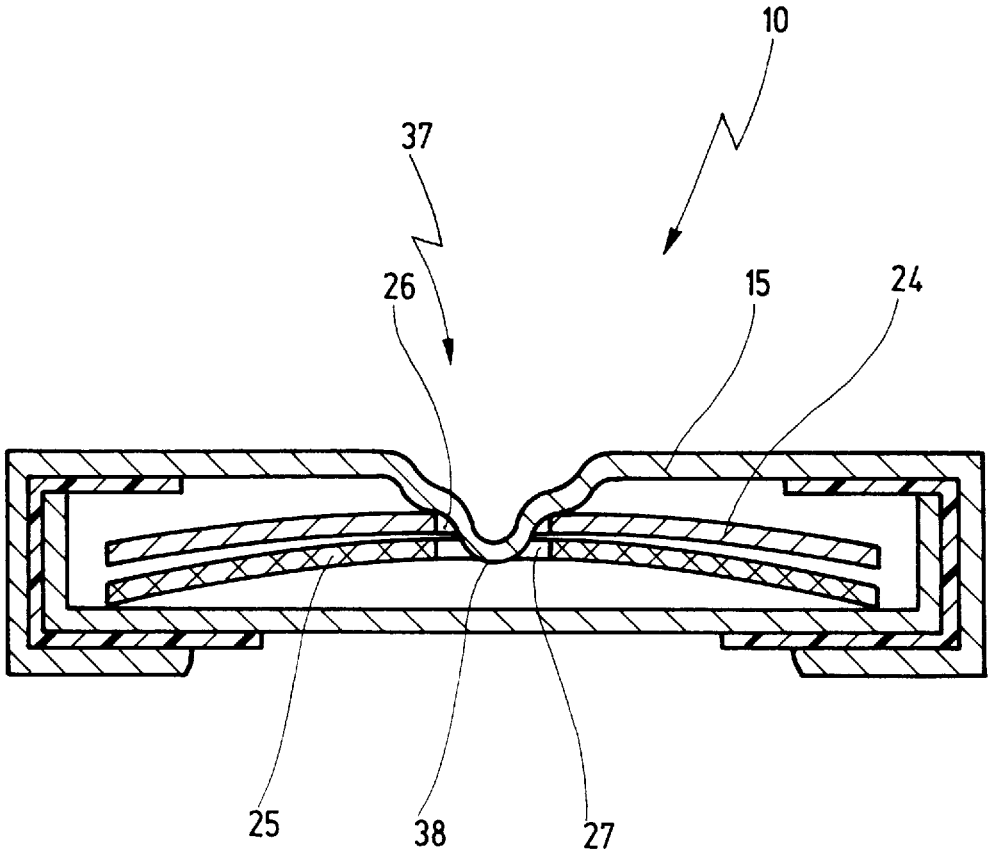
FIG. 4 shows a fourth embodiment of the new switch in a schematic longitudinal section.

Lastly, in FIG. 4, in an improvement of the embodiment according to FIG. 3, a first countercontact 37 is provided, the lug 38 of which extends through openings 26 and 27 in bimetallic snap disk 24 and spring disk 25. Only a very small number of components is required in this embodiment, since both countercontact 37 and its lug 38 are configured integrally with cover part 15 by deep-drawing. Assembly of this switch 10 is thereby greatly simplified in the manner described above.

In conclusion, it should be noted that in all the embodiments of FIGS. 1 to 4, spring disk 25 can be dispensed with if bimetallic snap disk 24 is itself configured as the electrically conductive spring element. Moreover, spring disk 25 can also be configured as a cup spring or spiral spring. The configuration as a spiral spring, in particular, is made possible here by the fact that the projection configured on the first countercontact can provide guidance, and thus prevent lateral deflection of the spiral spring.

I claim:

1. A temperature-dependent switch, comprising:

a housing having a lower housing part and a cover part capping said lower housing part;

a first countercontact provided at an inner surface of said cover part and having a projection pointing into said housing;

a second countercontact provided at an inner surface of said lower housing part;

a temperature-dependent switching mechanism arranged in said lower housing part and including an electrically conductive spring element having an opening;

said spring element assuming at least two distinct temperature-dependent switching positions, whereby in its first switching position said spring element is in contact with both said first and second countercontacts, thereby electrically interconnecting said first and second countercontacts;

said projection at said first countercontact protruding into said opening in said spring element at least when the latter has assumed its first switching position, such that said spring element is unrestrainedly positioned by said projection.

2. The switch of claim 1, wherein the projection is made of electrically conductive material.

3. The switch of claim 1, wherein the projection is made of electrically insulating material.

4. The switch of claim 1, wherein the projection extends, as a guide pin, to the inner surface of the lower housing part.

5. The switch of claim 1, wherein the spring element is retained in lossproof fashion on the projection.

6. The switch of claim 5, wherein the projection has a thickened head over which the spring element is slid in snap-lock fashion.

7. The switch of claim 1, wherein the spring element is a pretensioned bimetallic snap disk.

8. The switch of claim 1, wherein said temperature-dependent switching mechanism includes a bimetallic snap disk having an opening said bimetallic snap disk is arranged with said opening on the projection and in contact with the spring element.

9. The switch of claim 1, wherein the cover part is made of electrically conductive material, and the first countercontact is deep-drawn out of the material.

10. The switch of claim 9, wherein the projection is also deep-drawn out of the material.

11. The switch of claim 1, wherein said temperature-dependent switching mechanism comprises a bimetallic snap disk having an opening said bimetallic snap disk is arranged with said opening on the projection and in contact with said spring element.

12. A temperature-dependent switch, comprising:

a housing having a lower housing part and a cover part capping said lower housing part;

first countercontact provided at an inner surface of said cover part and having a projection pointing into said housing;

a second countercontact provided at an inner surface of said lower housing part;

a temperature-dependent switching mechanism arranged in said lower housing part and including an electrically conductive spring element having an opening;

said spring element assuming at least two distinct temperature-dependent switching positions, whereby in its first switching position said spring element is in contact with both said first and second countercontacts, thereby electrically interconnecting said first and second countercontacts;

said projection at said first countercontact protruding into said opening in said spring element at least when the latter has assumed its first switching position, wherein the projection is made of electrically insulating material.

13. A temperature-dependent switch, comprising:

a housing having a lower housing part and a cover part capping said lower housing part;

a first countercontact provided at an inner surface of said cover part and having a projection pointing into said housing;

a second countercontact provided at an inner surface of said lower housing part;

a temperature-dependent switching mechanism arranged in said lower housing part and including an electrically conductive spring element having an opening;

said spring element assuming at least two distinct temperature-dependent switching positions, whereby in its first switching position said spring element is in contact with both said first and second countercontacts, thereby electrically interconnecting said first and second countercontacts;

said projection at said first countercontact protruding into said opening in said spring element at least when the latter has assumed its first switching position, wherein the projection has a thickened head over which the spring element is slid in snap-lock fashion, such that the spring element is retained in loss-proof fashion on the projection.

14. A temperature-dependent switch, comprising:

a housing having a lower housing part and a cover part capping said lower housing part;

a first countercontact provided at an inner surface of said cover part and having a projection pointing into said housing;

a second countercontact provided at an inner surface of said lower housing part;

a temperature-dependent switching mechanism arranged in said lower housing part and including an electrically conductive spring element having an opening;

said spring element assuming at least two distinct temperature-dependent switching positions, whereby in its first switching position said spring element is in contact with both said first and second countercontacts, thereby electrically interconnecting said first and second countercontacts;

said projection at said first countercontact protruding into said opening in said spring element at least when the latter has assumed its first switching position, such that said spring element is unrestrainedly positioned by said projection, wherein the cover part is made of electrically conductive material, and the first countercontact and the projection are deep-drawn out of the material.

* * * * *